United States Patent [19]

Johnson

[11] 4,197,158

[45] Apr. 8, 1980

[54] PAPER MAKING MACHINE PRESS SECTION

[75] Inventor: Richard E. Johnson, Beloit, Wis.

[73] Assignee: Beloit Corporation, Beloit, Wis.

[21] Appl. No.: 887,048

[22] Filed: Mar. 16, 1978

[51] Int. Cl.[2] ..... D21F 3/04

[52] U.S. Cl. ..... 162/305; 162/360 R

[58] Field of Search ..... 162/305, 360 R, 205

[56] References Cited

U.S. PATENT DOCUMENTS

| | | | |
|---|---|---|---|
| 2,209,757 | 7/1940 | Berry | 162/360 R X |
| 2,618,205 | 11/1952 | Heys | 162/360 R X |
| 3,861,996 | 1/1975 | Dorfel | 162/360 R X |
| 3,997,391 | 12/1976 | Ortolani | 162/360 R |
| 4,059,482 | 11/1977 | Kankaanpaa | 162/360 R X |
| 4,086,131 | 4/1978 | Rempel | 162/360 R X |

*Primary Examiner*—Richard V. Fisher

*Attorney, Agent, or Firm*—Hill, Van Santen, Steadman, Chiara & Simpson

[57] ABSTRACT

A press section for a paper making machine including rolls arranged to form five sequential press nips for pressing a multi-ply web with each of the nips being a double felted press, and the first nip formed between first and second rolls with the first roll having a suction gland extending between the first and second nip and the third roll having a suction gland extending between the second and third nip with the felts on the outer side of the web separated from the web immediately on the offrunning side of the first and second nips so that the outer surface of the web is exposed to atmosphere with a suction gland within the felt supporting the web so that water is first drawn from one side of the web and then the other side after passing through double felted nips.

8 Claims, 2 Drawing Figures

PAPER MAKING MACHINE PRESS SECTION

BACKGROUND OF THE INVENTION

Figure 1:
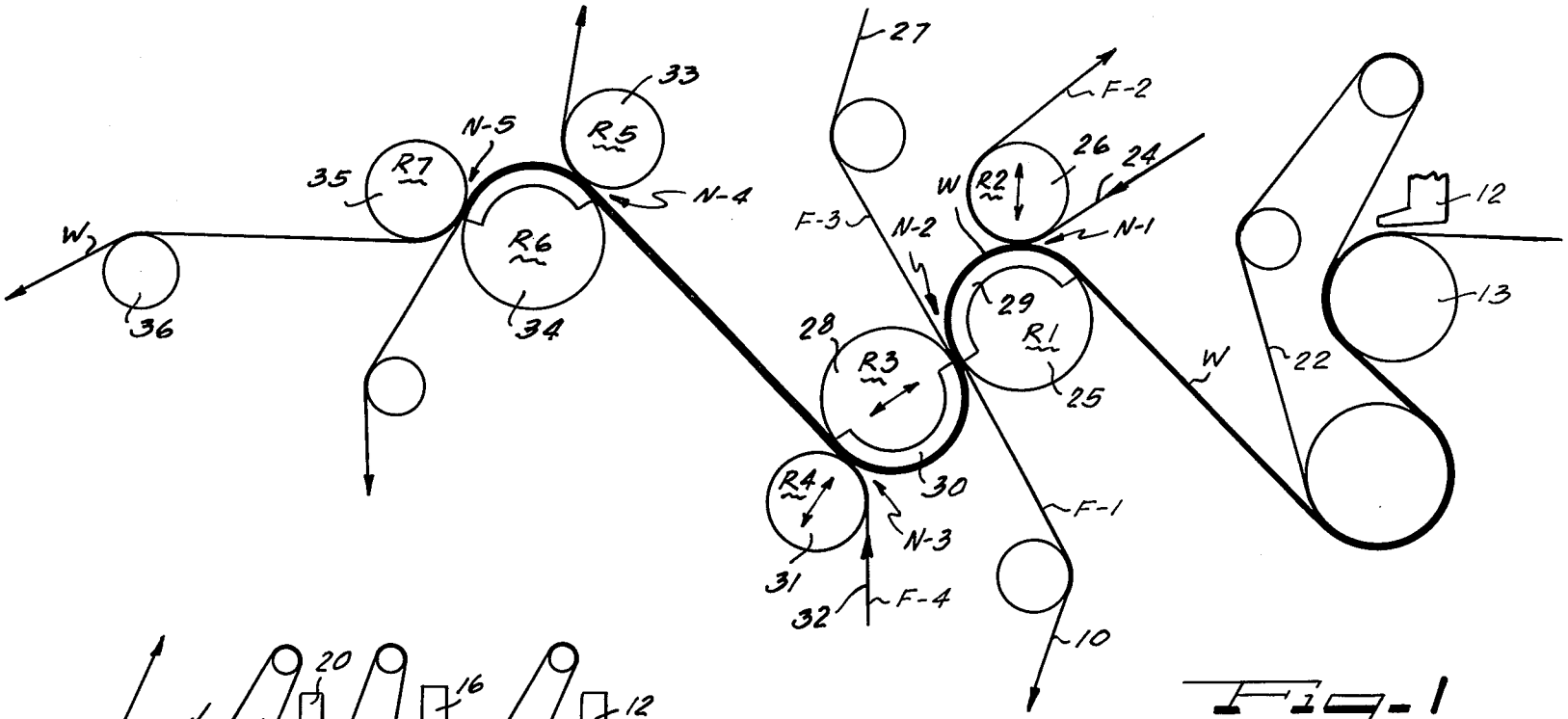

The present invention relates to improvements in paper making machines, and more particularly to an improved press section for pressing water from multi-ply board, and more particularly to a press section having a plurality of double felted nips arranged to dewater multi-ply board without disturbing the ply bond between the layers.

In the formation of multi-ply board of the type used for products such as soapboxes, food packages, cereal boxes and shoe boxes, the board or web is formed in individual plies with sequential plies laid on top of each ply until the desired number of plies are formed. The multi-ply board is then passed through a series of press nips for further dewatering before traveling to a dryer section. In the formation section of the machine where the layers are placed one on top of the other, dewatering usually has to be done through a number of plies to that the board is relatively wet as it passes through the press section. The interlock between the plies is formed by the fibers of paper stock, and this is known as "ply bond". It is essential that this orientation between the fibers which forms the ply bond not be disturbed to maintain maximum ply bond for strength of the board. Substantial care is taken and machine formation is particularly directed at obtaining an improved ply bond in the forming section so that this should not be reduced and instead, if possible, it should be enhanced in the press section.

It has been discovered that the fiber orientation which creates the ply bond is damaged and the strength of the ply bond reduced by rapid dewatering or crushing. This crushing is caused by the phenomena of hydraulic pressure forming within the interstices between the fibers if the water is caused to rush out too fast from high pressure pressing in the press section. In single ply webs the crushing disorients the fibers and damages the paper, and in multi-ply board, this damage also manifests itself in the destruction of the ply bond. It is, therefore, essential in removing the substantial quantities of water which must be removed in multi-ply board that crushing does not occur to reduce the strength of the ply bond.

It has also been discovered that if the multi-ply web is carried around a roll between two felts, because the outer felt must travel over a longer distance than the inner felt, a shear is induced on the web tending to separate the plies. In other words the surface of the outer felt which is in engagement with the wet web must travel over a longer distance than the surface of the inner felt which is in contact with the other surface of the web so that a shifting or shear stress is induced in the web tending to force the outer surface in one direction and the inner surface in another direction which separates the fragilly united fibers forming the ply bond. Yet, it is desirable for the sake of applying higher nip pressures to carry the web between two felts in passing through the nip. The present invention contemplates providing a press which utilizes the advantages of a double felted press nip without the disadvantages of the phenomena of ply bond destruction.

It is accordingly an object of the present invention to provide an improved press section for a multi-ply board making machine capable of dewatering a multi-ply web without disturbing the bond between the plies.

A further object of the present invention is to provide an improved section of a multi-ply paper making machine which is capable of removing substantial amounts of water from the web without causing crushing and consequent disturbance of ply bonding.

A further object of the invention is to provide an improved press arrangement particularly well suited for multi-ply web which is capable of successful and improved dewatering at high speeds for board making and which avoids the disadvantages of crushing and loosening of ply bonding.

Other objects, advantages and features will become more apparent, as will equivalent structures and methods which are intended to be covered herein, with the teaching with the principles of the invention in connection with the disclosure of the preferred embodiment in the specification, claims and drawings, in which:

DRAWINGS

Figure 2:
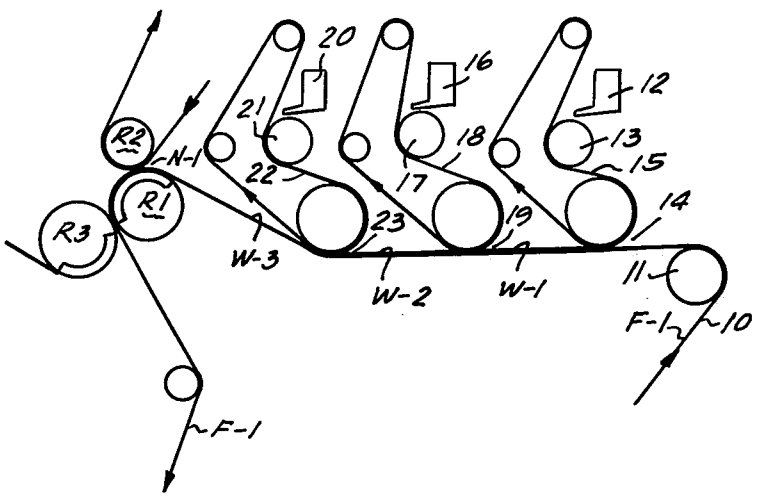

FIG. 1 is a front elevational view of a press section of a paper making machine, shown in schematic form, embodying the principles of the present invention; and FIG. 2 is a side elevational view, shown in schematic form, of a forming section of machine of the type for making or forming multi-ply bond to be handled by a press section such as that shown in FIG. 1.

DESCRIPTION

Referring first briefly to FIG. 2, this Figure illustrates one form of multi-ply board former which may be used, but it will be understood that the multi-ply web may be made in other designs of formers.

In the form as shown, a felt 10 F-1 passes over a roll 11 to travel in a straight run for receiving the sequence of plies thereon. The first ply is made by a headbox 12 discharging stock into the forming throat between a traveling wire 15 and a forming roll 13. The web passes downwardly on the wire 15 and is laid onto the felt 10 at location 14. The first layer of the board W-1 travels along to the second forming section to receive the second layer W-2 on the upper surface. The second layer is formed by a headbox 16 discharging a layer of stock into the forming throat between a wire 18 and a forming roll 17. The second layer is carried downwardly and laid onto the first layer W-1 at location 19, and the two layers travel on to receive a third layer W-3. The third layer is formed by a headbox 20 discharging into a throat formed between a forming wire 22 and the forming roll 21. At location 23 the third layer is laid onto the second layer, and the three layers interfaced and joined by the ply bond travel along on the felt 10 into the first nip N-1 formed between a first roll R-1 25 and a second roll R-2 26.

The rolls in addition to receiving number designations, will receive sequential roll numbers with the preface "R", and the felts will receive a designation with the preface "F" for ease of identification.

As illustrated in FIG. 1, the web carried on the first felt 10 from the forming section passes into the first nip N-1 between the roll R-1, and the roll R-2 26. It enters the nip substantially immediately after taking the curvature of the roll 25, and the suction gland 29 extends far enough to get the web onto the roll curvature. The first nip N-1 is a double felted nip and a second felt F-2 24 also passes through the nip N-1 sandwiching the web therebetween. The second felt F-2 is wrapped around the roll R-2 on the offrunning side so as to separate immediately from the web. The web is sandwiched between felts, therefore, only in the nip where the felts are essentially traveling at the same speed so that there is no scuffing or scrubbing which causes shear stress on the web. Two advantages are obtained, first the web is not first taken any substantial distance around a roll, but is passed immediately so that the layers between plies are not subjected to prolonged bending. Second, the web is subjected immediately to a double felted press and the outer felt then is immediately lifted off the web on the offrunning side. Following the nip N-1, the web follows down on the offrunning side of the nip N-1 supported on the felt F-1. The first roll R-1 is an open roll, that is, has perforations therethrough with a suction gland 29 therein. The suction gland extends through essentially 170° from the first nip to the second nip N-2. Thus, the web is first dewatered through its first lower surface in the first nip and then the other or second surface of the web is exposed to atmosphere so that the suction in the suction gland 29 can continue to draw water in the direction of the first surface of the web downward into the felt F-1.

In the second nip, the flow of water is reversed, and water is drawn through the other or second surface of the web by a suction gland 30 within a third roll 28 R-3. The second nip N-2 is a double felted nip with a third felt F-3 27 passing down into the nip and wrapping the third roll 28 R-3 on its offrunning side. The first felt F-1 is immediately separated from the web on the offrunning side of the second nip so as to expose the first surface of the web to the atmosphere premitting water to be drawn into the felt F-3 by the suction box 30 which extends from the second nip N-2 through the third nip N-3 and extends for essentially 170°.

The third nip N-3 is formed between the roll R-3 and a fourth roll R-4 31. The roll R-4 is preferably a plain roll, but can be a grooved roll. Similarly, the second roll R-2 is preferably a plain roll, but can be a grooved roll.

The third nip N-3 is a double felted nip with a fourth felt F-4 32 passing through the third nip and sandwiching the web therebetween.

The web then travels upwardly between the felt F-3 and felt F-4 to a fourth nip N-4 formed between a fifth roll R-5 33 and a sixth roll R-6 34.

On the offrunning side of the nip N-4, the web will follow the felt R-4 because the roll R-6 is a suction roll with the gland therein extending from the nip N-4 through the nip N-5. The nip N-5 is formed between a plain roll R-7 35, and the suction roll R-6. The web on the offrunning side of the nip N-5 follows the plain roll R-7 over a guide roll 36 to the drier section of the machine. Roll R-7 is a plain covered roll such as rubber and is a non-felted roll so that the nip N-5 is a single felted nip.

As will be noted, nips N-1, N-2, N-3 and N-4, are all double felted so that water is removed in both directions. Between the nips N-1 and N-2 and between the nips N-2 and N-3, there is air movement through the web induced by the suction gland within the rolls, and the outer exposed surface of the web is free between these nips. The double felting in each of the first four nips permits the nips to be loaded greater for increased water removal. Yet, the web is not sandwiched between two felts for any distance of travel over the periphery of a roll, but only between two felts for the time that the web travels through a nip. As is known in a multi-ply web former the speeds employed are relatively slower than in a single ply machine, and speeds of 1,000 to 1,200 feet per minute are well suited for use with the present mechanism.

The multi-ply web paperboard generally processed by the equipment illustrated will range on the order of 60 pounds/1,000 square feet to 160 pounds/1,000 square feet basis weight, and the apparatus shown will be capable of reducing the moisture by 30% to 40% without disturbing the web structure.

As the web comes off the former and is entering the first nip, a typical dryness will be on the order of 12% fiber. Upon passing the second nip, the web will be expected to have a dryness on the order of 30% fiber, having had the water removed in both directions. Upon passing the fifth nip on its way to the drier, it will be expected to have on the order of 40% fiber.

The nip loads are successively greater in the various nips varying in the range of a plus or minus 50 PLI with the load in nip N-1 on the order of 200 PLI, and nip N-2 300 PLI, and nip N-3, 400 PLI and nip N-4, 500 PLI, and in nip 5, 600 PLI.

A general range to be expected as to dryness would be 12% to 15% fiber, i.e., 85% to 88% water in coming off the former. After the last felted press, the web would have on the order of 50% to 60% water, or in other words, 40% to 50% fiber. It is to be understood that while the preferred mode is illustrated, that advantages are found in subcombinations of the apparatus illustrated as set forth in the claims appended hereto, and that while coaction between all of the elements is found in the entire combination, coaction in subcombinations thereof is also achieved. Thus, it will be seen that I have provided an improved paper making press section which provides improved multi-ply board and attains the advantages and objectives hereinabove set forth.

I claim as my invention:

1. A press mechanism for pressing water from a multilayer traveling paper web comprising in combination:

a first felt for receiving a multilayer wet web from a forming section;

a first press nip formed between a first press roll and a second open press roll with a suction gland therein with the first felt traveling over said second roll;

a second press felt passing through said first nip over said first roll with the web in a double felted pressing relationship;

said second felt guided away from the web substantially immediately following the first nip with the web following the first felt;

a second press nip formed between an open third press roll and said second press roll receiving said first felt;

said first felt guided away from the web following said second nip;

said second roll suction gland extending from said first to said second nip for draining water into said first nip;

a third felt passing through said second nip with said web in a double felted pressing relationship;

a third press nip formed between said third press roll and a fourth press roll;

said third press roll having a suction gland therein extending from said second to said third nip;

a fourth felt passing through the third nip with the web in a double felted pressing relationship with the third and fourth felts;

and a fourth press nip formed between a fifth and a sixth press roll receiving the web sandwiched between said third and said fourth felt.

2. A press mechanism for pressing water from a multilayer traveling paper web constructed in accordance with claim 1:

and including a fifth nip formed between a seventh roll and said sixth roll with the web and said fourth felt passing through the fourth press nip.

3. A press mechanism for pressing water from a multilayer traveling paper web constructed in accordance with claim 1:

wherein said sixth roll is a grooved roll.

4. A press mechanism for pressing water from a multilayer traveling paper web constructed in accordance with claim 1:

wherein said first nip is positioned substantially immediately as the first felt engages said second press roll.

5. A press mechanism for pressing water from a multilayer traveling paper web comprising in combination:

a first felt for receiving a multilayer wet web from a forming section;

a first press nip formed between a first press roll and a second open press roll with a suction gland therein with the first felt traveling over said second roll;

a second press felt passing through said first nip over said first roll with the web in a double felted pressing relationship;

said second felt guided away from the web substantially immediately following the first nip with the web following the first felt;

said first press nip positioned substantially immediately as the first felt engages the second press roll so that the first felt wraps the second press roll only after passing through the first nip;

a second press nip formed between an open third press roll and said second press roll receiving said first felt;

said first felt guided away from the web following the second nip;

said second roll suction gland extending from said first to said second nip for draining water into said first felt;

a third felt passing through said second nip with said web in a double felted pressing relationship;

a third press nip formed between said third press roll and a fourth press roll;

said third press roll having a suction gland therein extending from said second to said third nip;

and a fourth felt passing through the third nip with the web in a double felted pressing relationship.

6. A press mechanism for pressing water from a multilayer traveling paper web constructed in accordance with claim 5:

wherein said second felt is separated from the web immediately following the first nip and said first felt is separated from the web immediately following said second nip.

7. A press mechanism for pressing water from a multilayer traveling paper web comprising in combination:

a plurality of press rolls arranged to form a series of successive nips including first and second rolls forming a first nip therebetween, a third roll forming a second nip with said first roll and a fourth roll forming a third nip with said third roll;

felts wrapped over each of the rolls providing double felted nips between the rolls;

said felts which are located on the outer surface of the web being removed from the web immediately on the offrunning side of said first and second nips;

suction glands within the first and third rolls causing an in-flow of water through the web into the felt over each of said first and third rolls;

and said first nip located immediately after the web reaches the first roll to be pressed before the web is subjected to wrapping over the first roll over any substantial distance.

8. A press mechanism for pressing water from a multilayer traveling paper web constructed in accordance with claim 7:

wherein the suction gland within the first roll extends to the location where the web begins to wrap the first roll.

* * * * *